US011156015B1

(12) United States Patent
Hoggan

(10) Patent No.: US 11,156,015 B1
(45) Date of Patent: Oct. 26, 2021

(54) CHAIN LINK FENCE WITH RETAINED SLATS

(71) Applicant: Patrick R. Hoggan, North Logan, UT (US)

(72) Inventor: Patrick R. Hoggan, North Logan, UT (US)

( * ) Notice: Subject to any disclaimer, the term of this patent is extended or adjusted under 35 U.S.C. 154(b) by 0 days.

(21) Appl. No.: 14/702,292

(22) Filed: May 1, 2015

(51) Int. Cl.
*E04H 17/06* (2006.01)
*E04H 17/08* (2006.01)

(52) U.S. Cl.
CPC ..... *E04H 17/066* (2013.01); *E04H 17/08* (2013.01)

(58) Field of Classification Search
CPC ..... E04H 17/02; E04H 17/06; E04H 17/066; E04H 17/16; E04H 17/161
See application file for complete search history.

(56) References Cited

U.S. PATENT DOCUMENTS 2,753,156 A * 7/1956 Rieger ..... E01F 7/02 256/12.5
2,760,759 A 8/1957 Rice
2,802,645 A * 8/1957 Rice ..... E04H 17/02 256/34
3,069,142 A 12/1962 Kessler
4,085,954 A * 4/1978 Thompson ..... B21F 29/02 256/34
4,512,556 A 4/1985 Meglino
4,725,044 A 2/1988 Cluff
4,836,505 A 6/1989 Meglino
4,860,997 A * 8/1989 Schoenheit ..... E04H 17/066 256/34
5,007,619 A * 4/1991 Sibeni ..... B21F 29/02 245/11
5,056,761 A 10/1991 Meglino
5,106,058 A 4/1992 Finkelstein
5,275,381 A 1/1994 Cluff
5,584,468 A 12/1996 Meglino
5,775,676 A * 7/1998 Hoggan ..... E04H 17/066 256/32
5,794,922 A 8/1998 Meglino
5,799,929 A 9/1998 Meglino
5,806,839 A 11/1998 Meglino
6,068,243 A 5/2000 Hoggan
6,164,628 A 12/2000 Hoggan
6,182,947 B1 2/2001 Meglino
6,634,623 B2 10/2003 Torres
6,966,547 B2 * 11/2005 Colliander ..... E04H 17/066 256/1

(Continued)

*Primary Examiner* — Jonathan P Masinick
(74) *Attorney, Agent, or Firm* — Preston P. Frischknecht; Project CIP

(57) ABSTRACT

A chain link fence with retained slats having slats inserted into the chain link fence and running between the top of the fence and the bottom of the fence. Between the top selvages and the top ends of the slats, between the bottom selvages and the bottom ends, of the slats, or between both the top selvages and the top ends of the slats and the bottom selvages and the bottom ends of the slats is inserted an elongate member having sufficient strength to retain the slats while also being sufficiently flexible to permit the chain link fence with the retained slats and the elongate member or members to be rolled in the traditional manner for a chain link fence, but not so flexible as to prevent the elongate member from being pushed into the desired position within the fence.

17 Claims, 4 Drawing Sheets

(56) References Cited

U.S. PATENT DOCUMENTS

| | | | | |
|---|---|---|---|---|
| 7,165,760 | B2 * | 1/2007 | Campbell | E04H 17/066 256/32 |
| 7,237,766 | B2 | 7/2007 | Lemay | |
| 7,878,487 | B2 * | 2/2011 | Pearson | E04H 17/066 256/34 |
| 8,366,078 | B2 * | 2/2013 | Meglino | E04H 17/066 256/34 |
| 2014/0145133 | A1 | 5/2014 | McClure | |

* cited by examiner

CHAIN LINK FENCE WITH RETAINED SLATS

BACKGROUND OF THE INVENTION

Field of the Invention

This invention relates to slats which are inserted into chain link fences in order to increase privacy and security, especially to the retention of such slats in a chain link fence.

Description of the Related Art

There are many patents for retaining, or locking, slats into a chain link fence.

These generally appear to fall into four major categories: (1) apertures in the sides of adjacent slats through which a retaining bar is placed; (2) a substantially U-shaped channel to receive an end of each slat placed at the bottom, the top, or both the bottom and the top of the slats; (3) a pin placed within and extending from each slat; and (4) fins extending from the sides of the slats to the knuckles of the fence, plus a fifth category of miscellaneous retaining devices.

In the first major category U.S. Pat. No. 4,512,556 such a retaining bar is, indeed, inserted through apertures in the slats. For U.S. Pat. No. 5,056,761 each slat is retained by one or more horizontal slats or strips intertwined in the fence wires and passed through aligned openings in the opposite sides of the slats; a strip can be unwound from a supply spool. (This could be inserted into a chain link fence, i.e., pre-inserted, prior to installation, or even shipment, of the fence and probably wound with the uninstalled fence for shipment; but such pre-installation would be difficult because the apertures would have to be precisely aligned for all the slats. A similar slat-retaining fence using a strip placed through apertures in the slats is manufacture offered for sale as the Top Lock Slat by Pexco of Atlanta, Ga.) In U.S. Pat. No. 5,106,058 a flexible belt (made from flexible material such as plastic, rubber, or the like) is horizontally inserted through apertures in the slats. For U.S. Pat. No. 5,584,468 slots (apertures) in slats receive a retaining bar. Slats having opposing slots (apertures) for receiving a retaining bar are the subject of U.S. Pat. No. 5,806,839. A support bar extends through opening in the slats of U.S. Pat. No. 6,182,947. And one embodiment for U.S. Pat. No. 6,966,547 involves an upper rail extending through apertures in slats.

Representative of the second major category, United States Patent Publication No. 2014/0145133 utilizes a U-shaped retainer having flanges to spring into cutouts in the slat. (The retainer is stated to be able to be at either the top or the bottom of the slats, but it is not indicated that a top retainer and a bottom retainer can be simultaneously employed. A second embodiment of U.S. Pat. No. 6,966,547 has sidewall on each slat which snap; into a retainer on the top, bottom, or both ends of the fence. Each slat in U.S. Pat. No. 7,878,487 has at least two notches on opposite faces into which barbs extend from the front and rear of the retaining channel; the retaining channel can be at the top or the bottom of the fence but is not stated to be simultaneously at the top and the bottom. Tabs on a U-shaped retaining bar at the bottom of the fence fit into apertures in the front and rear of the slats for U.S. Pat. No. 8,366,078. In a first variant of this major category U.S. Pat. No. 7,165,760 uses a retraining strip having protrusions, at least one of which protrusions fits into a notch near the bottom of each slat. In U.S. Pat. No. 4,085,954 a U-shaped retainer can support the slats from the bottom or be at the top or bottom or both of the slats but has no portion extending into any slat. And two examples of a second related variant exist. U.S. Pat. Nos. 2,760,759 and 2,802,645 are very similar to each other. Both involve slats that are supported by a horizontal slat or strip (or, in a different embodiment, attached to rigid connecting member). Proper alignment of the slats within each retainer would, however, be very time consuming.

Within the third major category U.S. Pat. No. 4,725,044 has a pin which locks into a slat through an aperture and limits the movement of the slat with respect the wire of a fence or, in a second embodiment, can wrap around a bottom rail installed on the fence. A member having a stop to retain a slat is insert into a slat of U.S. Pat. No. 5,794,922. And the claims of U.S. Pat. No. 5,799,929 seam to deal with third and fourth stops which are discussed but not claimed in U.S. Pat. No. 5,794,922. Installation of these pins would again require considerable time.

For the fourth major category U.S. Pat. No. 5,775,676 has fins which wedge into the knuckles of a fence; one embodiment also has strands, at the ends of the fins, to wrap around the knuckle. In U.S. Pat. No. 6,164,628 a first set and a second set of fins retain a slat in a chain link fence by engaging the knuckles of the fence. And a notch in a fin of a slat is intended to catch on a fence knuckle in U.S. Pat. No. 6,634,623.

For the miscellaneous category the one embodiment of U.S. Pat. No. 2,802,645 was noted above. Additionally, the slats of U.S. Pat. No. 3,069,142 are diagonally arranged, are attached to the wire of the fence with an integral clip, and are further retained with frictional force from slats that are perpendicularly diagonal to the other slats. In U.S. Pat. No. 4,836,505 a horizontal strip member is conventionally attached to the vertical slats; the strip member is made from any conventional materials, such as wood, metal, or extruded plastic. Picket members on one side of a chain link fence are, in U.S. Pat. No. 5,275,381 snappingly engaged with mounting members either woven into the fence or on the opposite side of the fence. An expandable corrugated slat of U.S. Pat. No. 6,068,243, uses spring force to retain such slat in the channel of a fence. In U.S. Pat. No. 7,237,766 a projections from a cap first into channels of adjacent slats. And in U.S. Pat. No. Re. 36,0385 each slat has a channel near one edge to retain the fence wire between adjacent knuckles and also has an attachable cover for such channel.

Notwithstanding this prior art, there is a significant absence in the industry of chain link fences with slat retention systems that optimize installation efficiency through, for example, pre-installed retention-type configurations that allow the entire system to be rolled or unrolled.

BRIEF SUMMARY OF THE INVENTION

The chain link fence with retained slats of the present invention comprises a traditional chain link fence with any fence slats inserted and running from top to bottom in the chain link fence. Between the top selvages and the tops of the slats, between the bottom selvages and the bottoms of the slats, or between both the top selvages and the tops of the slats and the bottom selvages and the bottoms of the slats is inserted an elongate member having sufficient strength to support the slats while also being sufficiently flexible to permit the chain link fence with the slats and the elongate member or members to be rolled in the traditional manner for a chain link fence but not so flexible as to prevent the elongate member from being pushed into the fence.

Such an elongate member can, therefore, along with the slats, be pre-inserted into the fence before installation, or even shipment, of the fence because of the physical composition of the elongate member and the relatively large space between the selvage and the end of the slats. The structure, composition, and shape of the elongate member will, though, after insertion preclude substantial movement of the slats thereby preventing a slat from exiting past the top or bottom of the fence.

The elongate member can have a circular, oval, or polygonal cross section and can be either hollow or solid. Unlike a U-shaped elongate member, the present elongate member need not be so stiff as to prevent its sides from collapsing and impeding the insertion of the end of a slat. Moreover, because the end of a slat does not need to enter the present elongate member, as an end of a slat must with a retaining U-shaped elongate member, a slat can be thicker than the present elongate member. And the present elongate member can work with a fence have any type of selvage, knuckle or twist or a combination thereof.

Preferably, the elongate member is attached to the wire of a the fence with one or more connectors, e.g., a hog ring. And if the fence is longer that the elongate member the adjacent ends of consecutive elongate members can, using any technology known to one of ordinary skill in the art (such as overlapping the adjacent ends of the consecutive elongate members and connecting such ends together with one or more connectors, e.g., a hog ring.

The present elongate member can, furthermore, function appropriately with any known type or size of fence slat and a chain link fence of any mesh size.

BRIEF DESCRIPTION OF THE SEVERAL VIEWS OF THE DRAWING

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE INVENTION

The present invention in its various embodiments, some of which are depicted in the figures herein, is a fence with retained slats.

Figure 1:
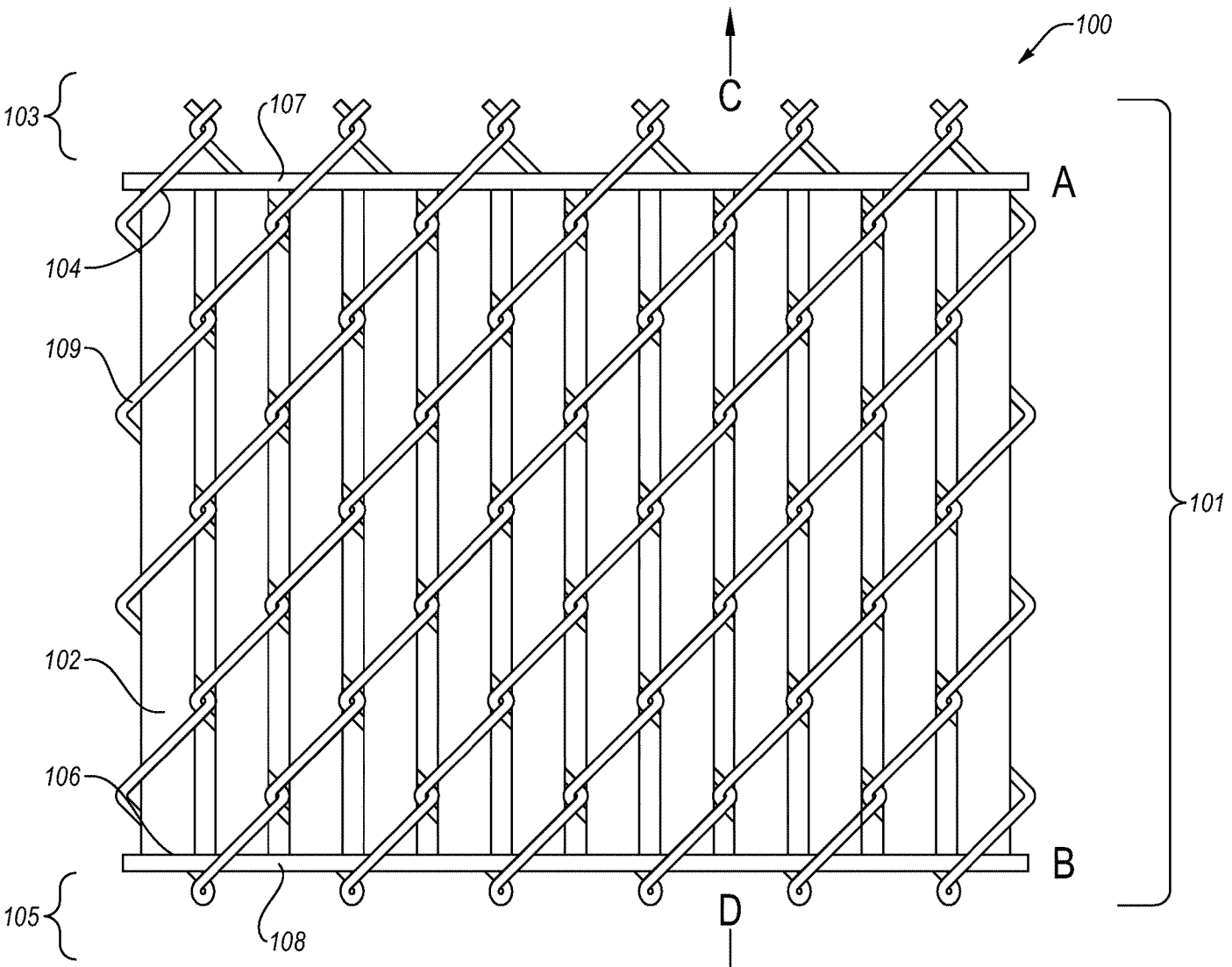
FIG. 1 is a front view of the chain link fence with retained slats.
Figure 2:
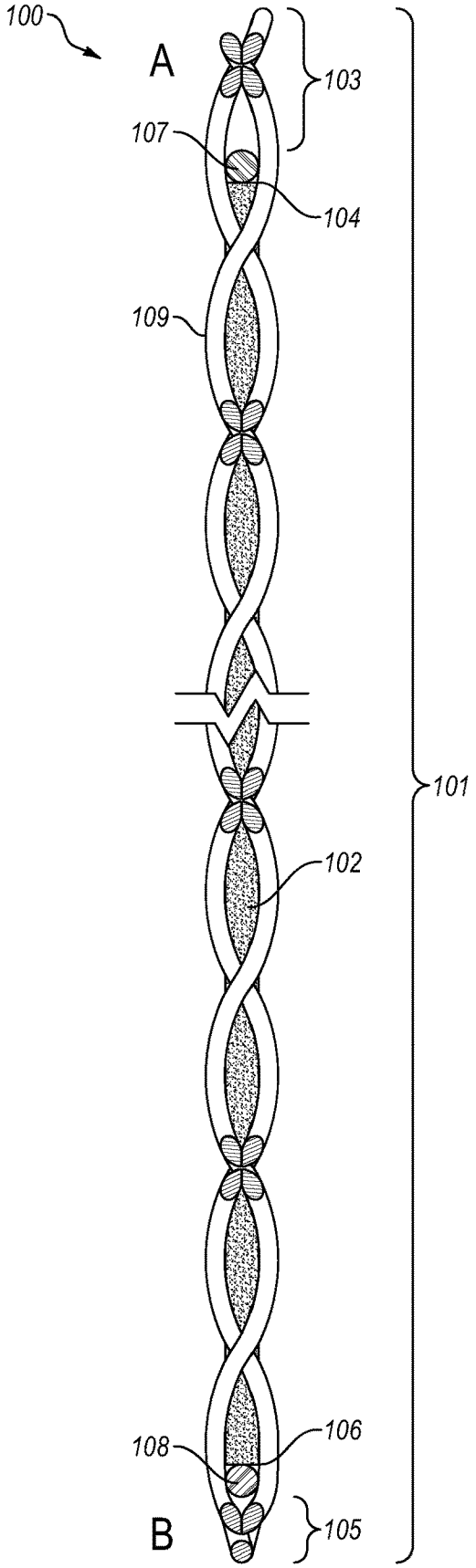
FIG. 2 is a side cross section view of the chain link fence with retained slats.
Figure 4:
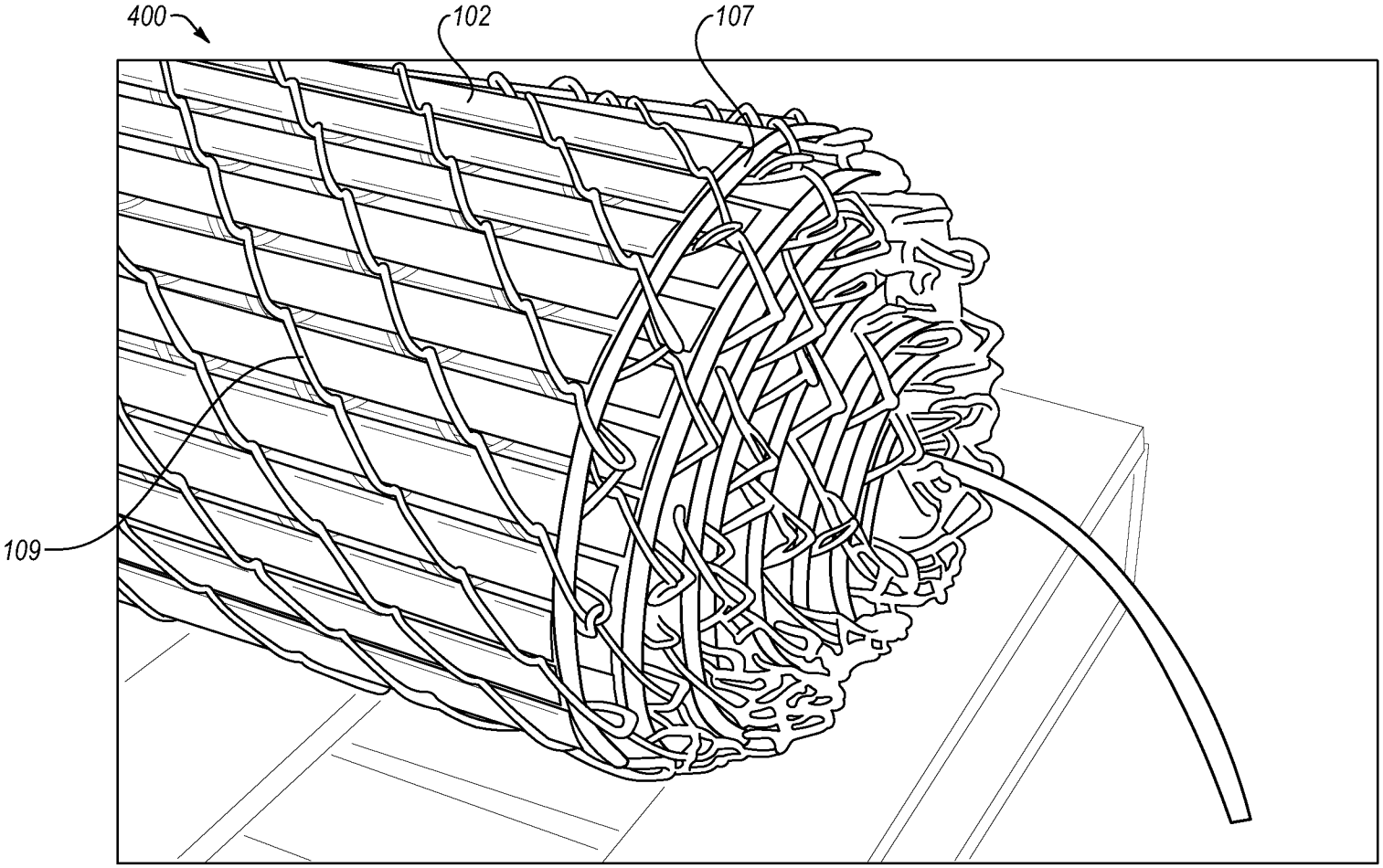
FIG. 4 is a perspective view of the chain link fence with retained slats in a rolled configuration.

As indicated above and illustrated in FIGS. 1 through 2, the chain link fence with retained slats 100 comprises a traditional chain link fence 101 with any fence slats 102 inserted and running from top A to bottom B in the chain link fence 101. Fence 101 with slats 102 has selvages 103, 105 at top and bottom. Top selvages 103 are collectively termed the top class of selvages, the bottom selvages 105 are collectively termed the bottom class of selvages, and the top class of selvages together with the bottom class of selvages are collectively termed the classes of selvages. Between top selvages 103 and top ends 104 of the slats 102, between bottom selvages 105 and bottom ends 106 of the slats 102, or between both top selvages 103 and top ends 104 of the slats 102 and bottom selvages 105 and bottom ends 106 of the slats 102 is one or more elongate members 107, 108. The one or more elongate members 107, 108 have sufficient strength to support and/or retain the slats 102 within the chain link fence and are also sufficiently flexible to permit the chain link fence with the retained slats and the elongate member or members 107, 108 to be rolled in the traditional manner for a chain link fence (see FIG. 4) but not so flexible as to prevent the one or more elongate members 107, 108 from being pushed into the desired position within the fence 101. The one or more elongate members 107, 108 are operable with fences of any selvage type, including knuckle (e.g., 105), twist (e.g., 103), or a combination thereof.

The functional properties of the one or more elongate members 107, 108 described above may be attained, in part, through construction of the one or more elongate members 107, 108 from certain flexible materials. A nonexclusive list of acceptable materials from which to construct the one or more elongate members 107, 108 comprises: low-density polyethylene (LDPE); high-density polyethylene (HDPE); polyvinyl chloride (PVC); and ethylene vinyl acetate (EVA), with low-density polyethylene being preferred because of its flexibility and low cost. The functional properties of the one or more elongate members 107, 108 may also be attained, in part, through their shape. The one or more elongate members 107, 108 can have a closed shape, including of circular, oval, or polygonal cross section that can also be either hollow or solid. The described functional properties and characteristics of the one or more elongate members 107, 108 may be obtained by using any other suitable materials and/or shapes without departing from the purpose and scope of the invention.

Figure 3:
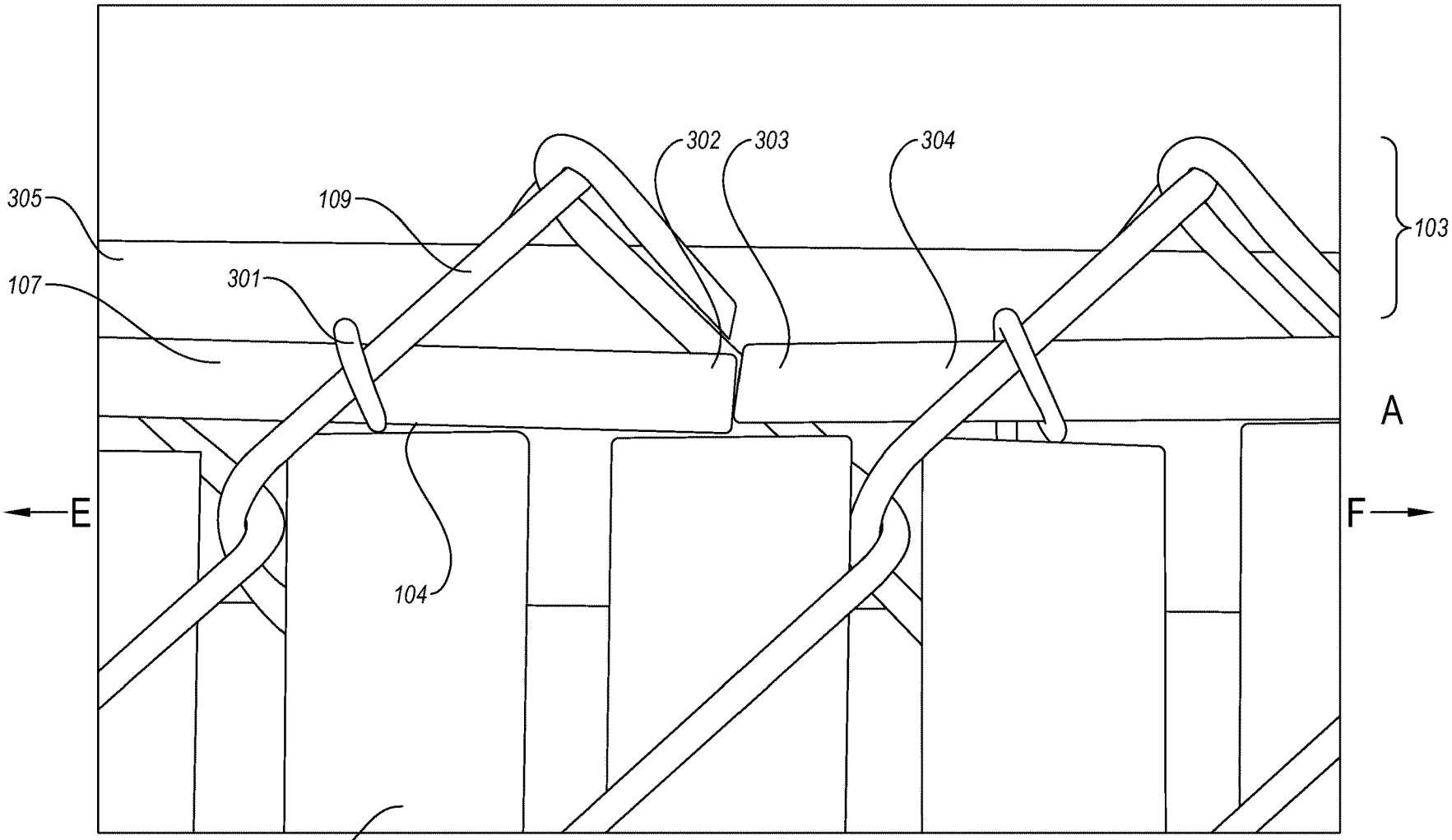
FIG. 3 is a front view of a portion of the chain link fence with retained slats.

Referring now to FIG. 3., preferably, the one or more elongate members 107 is attached to the wire 109 of the fence 101 with one or more connectors 301 such as a hog ring to prevent the one or more elongate members 107 from sliding from and/or within the fence 101. If the fence 101 is longer than the one or more elongate members 109, adjacent ends 302, 303 of consecutive elongate members 107, 304 can, using any technology known to one of ordinary skill in the art (such as overlapping the adjacent ends 302, 303 of consecutive elongate members 107, 304 and connecting such ends 302, 303 together with one or more connectors 301 such as a hog ring.

Thus configured a chain link fence with retained slats is provided that optimizes installation efficiency through a pre-installed retention-type configuration that allows the entire system to be rolled or unrolled.

As used herein the term "preferable" or "preferably" means that a specified element or technique is more acceptable than another but not that such specified element or technique is a necessity. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A chain link fence with retained slats comprising:

a chain link fence having wire, a top, a bottom, top selvages, and bottom selvages;

fence slats running from the top to the bottom in the chain link fence;

an elongate member inserted between a class of selvages and the nearer end of said slats to the class of selvages, the elongate member having a closed shape and sufficient strength to retain said slats within the chain link fence while also being sufficiently flexible to permit the chain link fence to be rolled but not so flexible as to prevent the elongate member from being pushed into the desired position within said chain link fence.

2. The chain link fence with retained slats of claim 1, wherein:

the elongate member is inserted between the top selvages and top ends of the slats.

3. The chain link fence with retained slats of claim 2, further comprising:

one or more connectors attaching the elongate member to the wire.

4. The chain link fence with retained slats of claim 1, wherein:

the elongate member is inserted between the bottom selvages and bottom ends of the slats.

5. The chain link fence with retained slats of claim 4, further comprising one or more connectors attaching the elongate member to the wire.

6. The chain link fence with retained slats of claim 1, wherein:

a first elongate member is inserted between top selvages and top ends of the slats; and a second elongate member is inserted between bottom selvages and bottom ends of the slats.

7. The chain link fence with retained slats of claim 6, further comprising one or more connectors attaching the elongate members to the wire.

8. The chain link fence with retained slats of claim 1, wherein the elongate member is constructed from one of the group of: low-density polyethylene, high-density polyethylene, ethylene vinyl acetate, and polyvinyl chloride.

9. A chain link fence with retained slats comprising:

a chain link fence having wire, a top, a bottom, top selvages, and bottom selvages;

fence slats having a top end and a bottom end inserted into the chain link fence and running from the top to the bottom in the chain link fence;

one or more elongate members constructed from one of low-density polyethylene, high-density polyethylene, ethylene vinyl acetate, and polyvinyl chloride;

a first of the elongate members inserted between the top selvages and the top ends of the slats;

a second of the elongate members inserted between the bottom selvages and the bottom ends of the slats;

each of the elongate members a closed shape and having sufficient strength to retain said slats while also being sufficiently flexible to permit the chain link fence to be rolled but not so flexible as to prevent the elongate member from being pushed into the desired position within said chain link fence; and one or more connectors attaching the elongate members to the wire.

10. A chain link fence with retained slats comprising:

a chain link fence;

a plurality of fence slats inside the chain link fence;

one or more flexible elongate members of closed shape for retaining the fence slats inside the chain link fence, the one or more flexible elongate members disposed between selvages of the chain link fence and slat ends of the plurality of fence slats nearest to the selvages;

the chain link fence with retained slats configured to be at least one of rolled or unrolled.

11. The chain link fence with retained slats of claim 10, the one or more flexible elongate members of closed shape for retaining the fence slats inside the chain link fence located adjacent a top end of the chain link fence.

12. The chain link fence with retained slats of claim 10, the one or more flexible elongate members of closed shape for retaining the fence slats inside the chain link fence located adjacent a bottom end of the chain link fence.

13. The chain link fence with retained slats of claim 11, further comprising two or more elongate members of closed shape for retaining the fence slats inside the fence.

14. The chain link fence with retained slats of claim 12, further comprising two or more elongate members of closed shape for retaining the fence slats inside the fence.

15. The chain link fence with retained slats of claim 10, further comprising a first elongate member of closed shape for retaining the fence slats inside the fence located adjacent a top of the chain link fence, and a second elongate member of closed shape for retaining the fence slats inside the fence located adjacent a bottom of the chain link fence.

16. The chain link fence with retained slats of claim 10, the one or more flexible elongate members made from one of the group of: low-density polyethylene, high-density polyethylene, ethylene vinyl acetate, and polyvinyl chloride.

17. The chain link fence with retained slats of claim 10, the one or more flexible members of closed shape for retaining the fence slats inside the chain link fence not so flexible as to prevent being pushed into selvages of the chain link fence.

* * * * *